US008939320B2

(12) United States Patent
Schiering et al.

(10) Patent No.: US 8,939,320 B2
(45) Date of Patent: Jan. 27, 2015

(54) WIPES DISPENSER AND DISPOSAL

(71) Applicant: Professional Disposables International, Inc., Orangeburg, NY (US)

(72) Inventors: Matthew Robert Schiering, New City, NY (US); Robert P. Julius, Greenwich, CT (US); Jerry Carstens, Elmsford, NY (US); Gerard Anthony Cahalan, New Milford, CT (US)

(73) Assignee: Professional Disposables International, Inc., Orangeburg, NY (US)

( * ) Notice: Subject to any disclaimer, the term of this patent is extended or adjusted under 35 U.S.C. 154(b) by 271 days.

(21) Appl. No.: 13/651,240

(22) Filed: Oct. 12, 2012

(65) Prior Publication Data

US 2014/0103058 A1 Apr. 17, 2014

(51) Int. Cl.
*B65D 83/08* (2006.01)

(52) U.S. Cl.
CPC ..... *B65D 83/08* (2013.01)
USPC ..... 221/102

(58) Field of Classification Search
CPC ..... B65D 83/08
USPC ..... 221/102; 206/225; 220/555
See application file for complete search history.

(56) References Cited

U.S. PATENT DOCUMENTS 1,292,463 A * 1/1919 Hayashi ..... 221/102
2,841,275 A 7/1958 Schwimmer et al.
2,841,276 A 7/1958 Schwimmer et al.
3,033,362 A 5/1962 Marcalus
3,072,245 A * 1/1963 Faltin ..... 221/34
3,141,569 A 7/1964 Hanson
3,331,498 A 7/1967 Davies
4,022,319 A 5/1977 Jenkins
4,469,243 A 9/1984 Ito et al.
4,879,442 A 11/1989 Giovine
4,887,713 A * 12/1989 Tupper ..... 206/225
5,054,612 A 10/1991 Meyer
5,909,832 A * 6/1999 French et al. ..... 206/223
6,098,805 A * 8/2000 Kent ..... 206/518
6,427,839 B1 * 8/2002 Helfer-Grand ..... 206/494
6,431,360 B1 * 8/2002 Julius ..... 206/494
6,571,985 B2 6/2003 Wilkes et al.
6,672,474 B2 1/2004 May et al.
6,702,147 B2 3/2004 Ashford
6,863,192 B2 3/2005 Tumlinson
7,252,209 B2 * 8/2007 Julius ..... 221/33
7,490,734 B2 2/2009 Carr
7,708,188 B2 * 5/2010 Stravitz et al. ..... 220/908.1
7,832,555 B2 11/2010 Flannery
8,783,508 B2 * 7/2014 Comerford ..... 221/96

(Continued)

FOREIGN PATENT DOCUMENTS

CA 2269379 A1 10/2000
EP 0371539 A2 6/1990
EP 0583831 A1 2/1994

*Primary Examiner* — Timothy Waggoner
(74) *Attorney, Agent, or Firm* — Christie, Parker & Hale LLP

(57) ABSTRACT

A dispenser and disposal assembly including a receptacle having a base, a front wall, a rear wall, and two side walls, wherein the walls extend from the base in a first direction and thereby form a cavity into which a divider is configured to be seated, thereby forming a first cavity and a second cavity. Additionally, a door is connected to the base of the receptacle, wherein the door is movable between a closed position and an open position.

19 Claims, 8 Drawing Sheets

(56) References Cited

U.S. PATENT DOCUMENTS

2009/0152290 A1 6/2009 Wang et al.
2009/0223993 A1 9/2009 Lorenzati
2010/0258580 A1 10/2010 Decker et al.

* cited by examiner

WIPES DISPENSER AND DISPOSAL

TECHNICAL FIELD

The present invention relates to dispenser and disposal assemblies, in particular, dispenser and disposal assemblies adapted for securing a package of dispensable wipes and conveniently storing used wipes in a separate compartment.

BACKGROUND OF THE INVENTION

Disposable moist wipes for sanitary use are frequently found in food establishments, food processing plants, and other health department regulated food facilities, such as school cafeterias and airplanes. Such wipes are typically used to sanitize hard, non-porous food contact surfaces in order to prevent cross-contamination. Disposable wipes are typically housed in a portable container or package. The package or container, however, is subject to damage from users, such as abrasions or tears, due to frequent and repeated use. Additionally, the portability of typical wipes packages and containers may inconvenience a user because the user may then have to search to find the nearest waste receptacle into which to discard the used wipes.

As such, it is desirable to have a portable wipes dispenser and disposal assembly having a compartment configured to protect a package of disposable wipes against damage and having a separate compartment for temporarily discarding used wipes.

SUMMARY OF THE INVENTION

The present invention is directed to a dispenser and disposal assembly for securing a package of disposable wipes and for storing used wipes in a separate compartment. In one embodiment, the assembly has a receptacle which has a base, a front wall, a rear wall, and two side walls. The walls extend from the base portion in a first direction and thereby form a cavity into which a divider portion is configured to be seated, thereby forming a first cavity and a second cavity. The first cavity is configured to receive an object, such as a package of disposable wipes. The second cavity is configured to receive various objects, such as used disposable wipes. In one embodiment, the front wall has a notched or stepped rectangular opening forming a guide channel configured to be coupled to a container, such as a lid assembly connected to a package of disposable wipes. The guide channel is configured to retain the package of disposable wipes in the first cavity. In another embodiment, the assembly has a handle extending in the first direction from the divider, wherein the handle aids in the portability of the assembly. In a more detailed embodiment, the assembly has a door connected to the base of the receptacle. The door is movable between a closed position and an open position. In the open position, the door opens into the second cavity of the receptacle. In a further embodiment, the door has a clasp for securing the door in the closed position. In another embodiment, the assembly has a lid connected to the receptacle and covering the second cavity of the receptacle. In one embodiment, the lid is hingedly connected to the receptacle.

Additional aspects and/or advantages of embodiments of the present invention are set forth in the following description and accompanying drawings, or may be obvious in view thereof to those skilled in the art.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

The present invention relates to wipes dispenser and disposal assemblies, in particular, dispenser and disposal assemblies adapted for securing a package of dispensable wipes and conveniently storing used wipes in a separate compartment. In general, the dispenser and disposal assembly is provided to accommodate a package of wipes or other articles as well as to provide a disposal area for used wipes that can be emptied without a user needing to contact the used wipes, and without needing to turn the assembly upside down, which might dislodge the package of wipes. Additionally, the assembly is configured to be easily transported.

Figure 1:
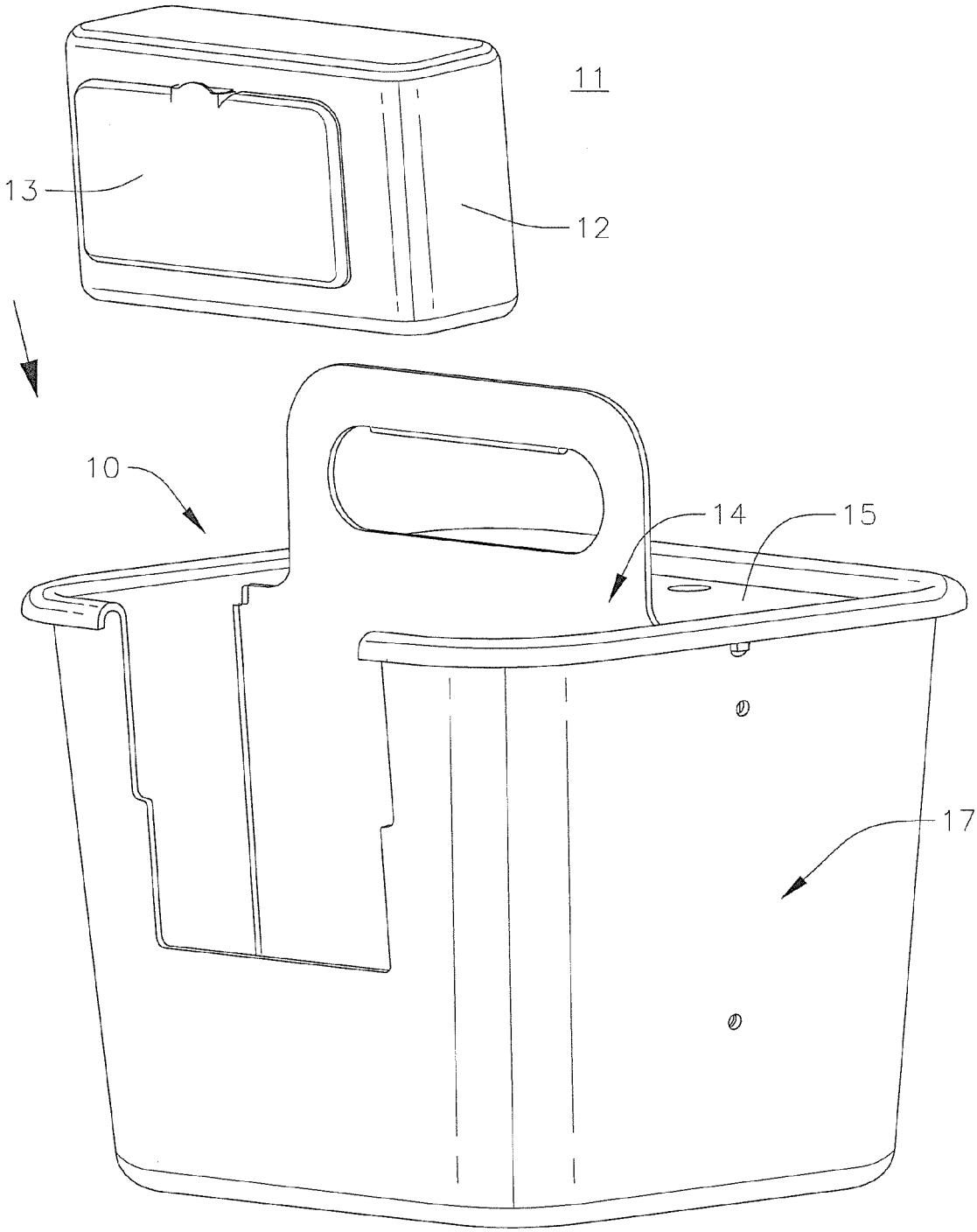
FIG. 1 is a perspective view of an embodiment of the wipes dispenser and disposal assembly, shown with a package of dispensable wipes being inserted therein.
Figure 2:
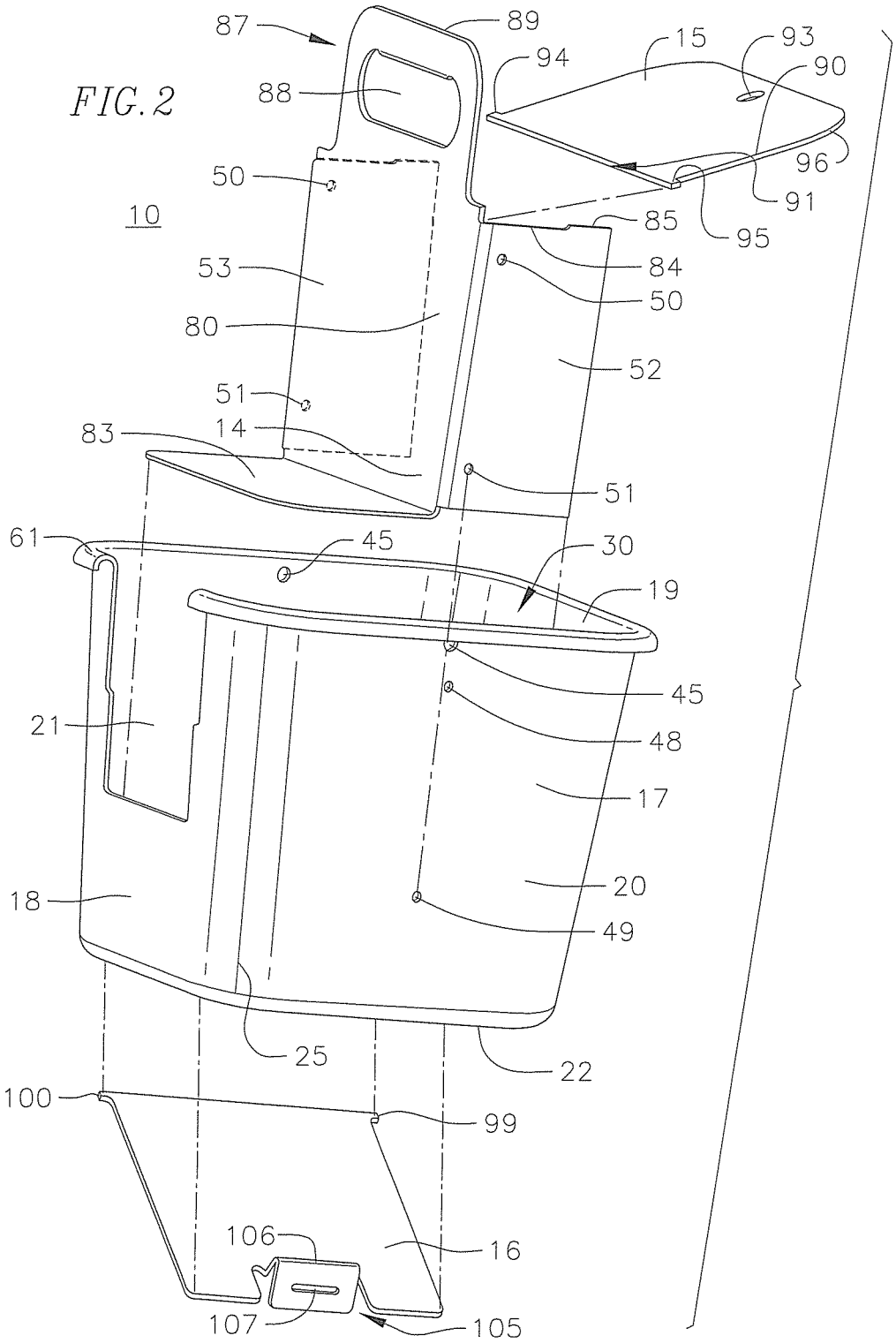
FIG. 2 is an exploded view of an embodiment of the wipes dispenser and disposal assembly.
Figure 3:
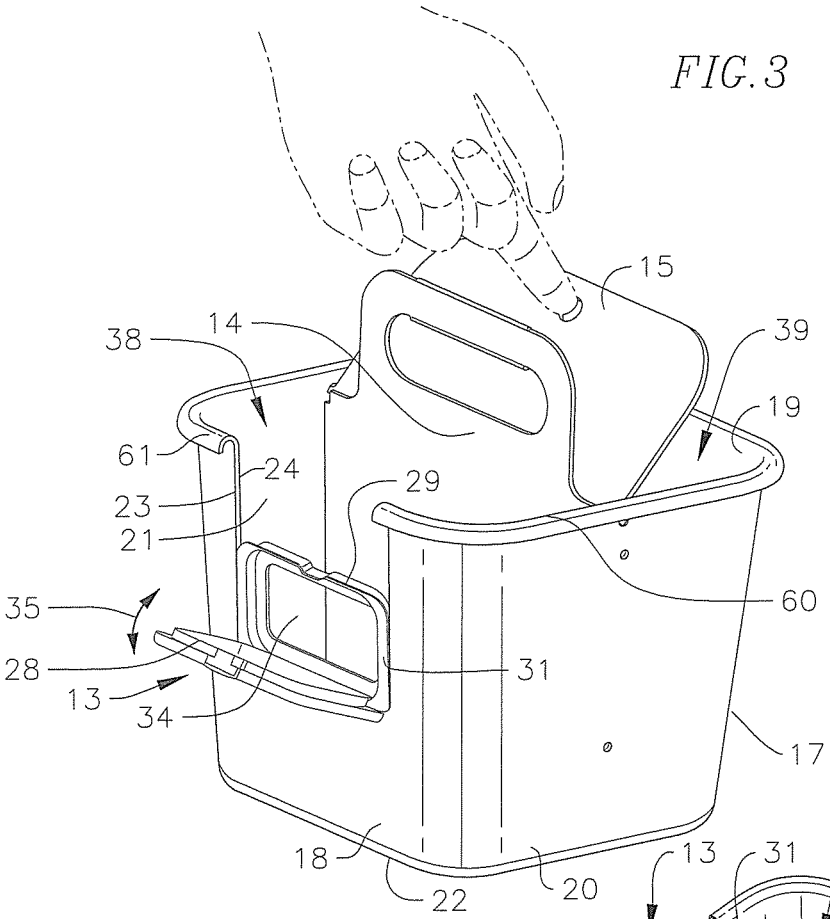
FIGS. 3 and 4 are perspective views of an embodiment of the wipes dispenser and disposal assembly, shown with a lid assembly of a package of dispensable wipes inserted therein.
Figure 4:
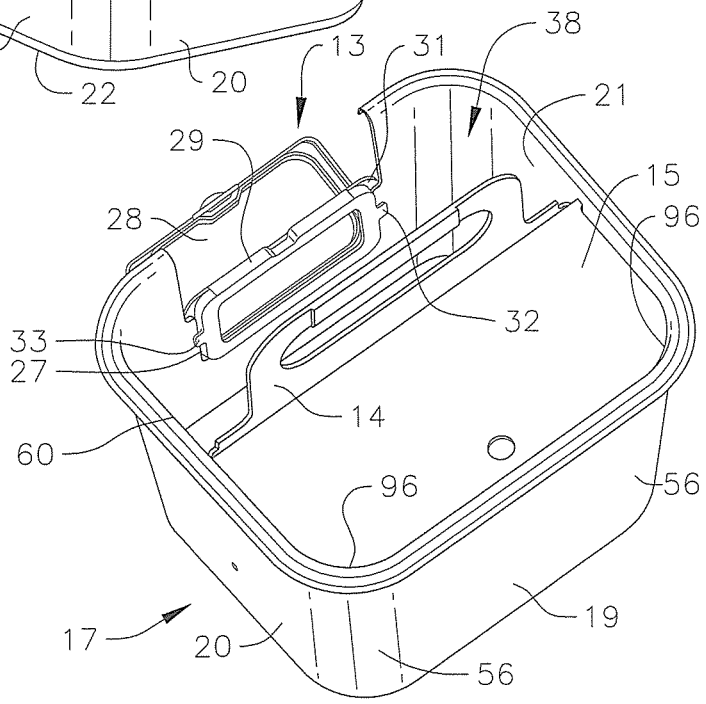
Figure 9:
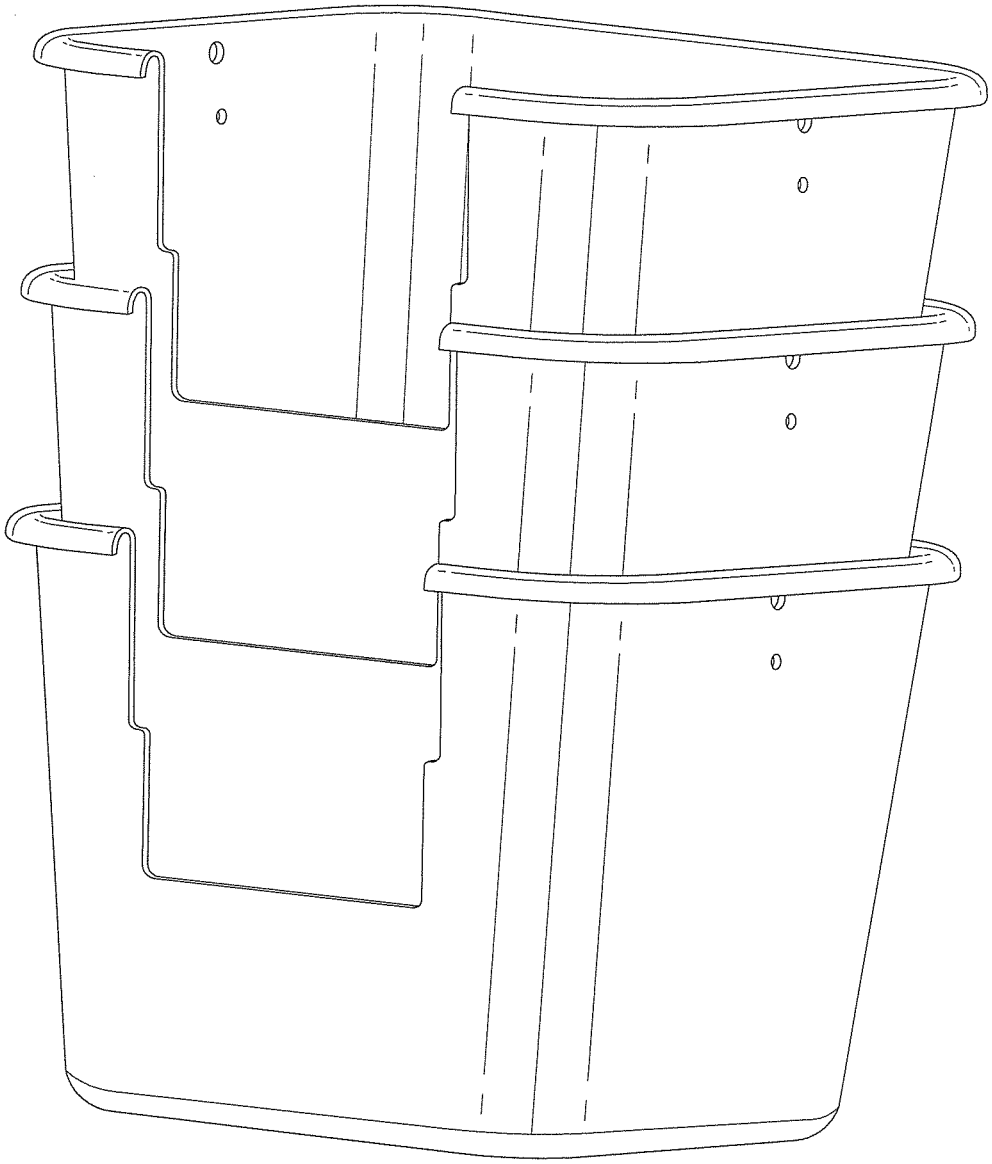
FIG. 9 is a perspective view showing several wipes dispenser and disposal assemblies in a stacked configuration.

In an embodiment of the present invention shown in FIG. 1, a wipes dispenser and disposal assembly 10 is provided for safely and securely holding an object 11, such as a package of dispensable wipes 12 having a lid assembly 13, and for separately storing other objects, such as used disposable wipes. As illustrated in FIGS. 2-4, the wipes dispenser and disposal assembly 10 generally includes a divider 14, a lid 15, a door 16, and a receptacle 17. The receptacle 17 comprises a front wall 18, a rear wall 19, two side walls 20 and 21, and a base 22. The front wall 18, the rear wall 19, and the two side walls 20 and 21, extend upward from the base 22 to form a cavity 30. In one embodiment, the front wall 18, the rear wall 19, and the two side walls 20 and 21, extend upward at a slight oblique angle (e.g., between about 90° and 100°) from the base 22. The slight oblique angle of the walls 18, 19, 20, and 21 relative to the base 22 facilitates stacking several receptacles 17 (e.g., three) for convenience during shipping or storage, as shown in FIG. 9. However, it will be understood that the specific slope angle of the walls 18, 19, 20, and 21 relative to the base 22 is not critical, and that the walls 18, 19, 20, and 21 could be sloped at any appropriate angle or not sloped at all to form a 90° angle with the base 22.

With continued reference to FIGS. 2-4, the walls 18, 19, 20, 21 form a rectangular top opening 60 through which the divider 14 can be inserted down into the cavity 30. That is, the divider 14 is configured to be seated or housed in the cavity 30 formed by the walls 18, 19, 20, and 21. When the divider 14 is seated or housed in the cavity 30, the walls 18, 19, 20, and 21 and the divider 14 form a front cavity 38 and a rear cavity 39. The front wall 18, the two side walls 20, 21, and the divider 14 form the front cavity 38, which is configured to receive the object 11, such as the package of disposable wipes 12 connected to the lid assembly 13. The walls 18, 20, 21 protect the object 11 stored in the wipes dispenser and disposal assembly 10 against damage, such as abrasions and tearing, due to handling by a user. Similarly, the rear wall 19, the two side walls 20, 21 and the divider 14 form the rear cavity 39, which allows used wipes or other articles to be disposed conveniently. The rear cavity 39 and the forward cavity 38 both have an open upper portion which leads down into the cavities 38, 39. A periphery of the rectangular top opening 60 is defined by the walls 18, 19, 20, 21. Additionally, an upper portion of the walls 18, 19, 20, 21 has an inverted "U-shaped" lip 61 formed along the periphery of the rectangular top opening 60. The U-shaped lip 61 protects the user during insertion of the package of disposable wipes 12 into the forward cavity 38 and during disposal of used wipes or other articles into the rear cavity 39. Otherwise, the periphery of the rectangular top opening 60 formed by the relatively thin walls 18, 19, 20, 21 would form a sharp edge against which the user could inadvertently cut his hand. However, it will be appreciated that the upper portion of the walls 18, 19, 20, 21 could have other configurations and still be within the scope and spirit of the present invention.

Referring now to FIG. 2, the divider 14 generally includes a wall 80 formed from a relatively thin sheet having a front surface and a rear surface. The wall 80 is configured to extend horizontally between the two side walls 20, 21 of the receptacle 17 and to extend vertically between the base 22 of the receptacle 17 and the top opening 60. Two substantially vertical attachment flaps 52, 53 extend rearward from opposite ends of the wall 80 and a substantially horizontal return flange 83 extends forward from a lower end of the wall 80. The attachment flaps 52, 53 are configured to rest flush against the inside surfaces of the side walls 20, 21 of the receptacle 17. Moreover, both of the attachment flaps 52, 53 contain a plurality of openings 50, 51 (e.g., two) configured to align with openings 48, 49, respectively, in the side walls 20, 21 of the receptacle 17. The openings 48, 49, 50, 51 in the side walls 20, 21 and the attachment flaps 52, 53 are configured to receive a plurality of fasteners, such as pop rivets, securing the divider 14 to the receptacle 17. In an alternative embodiment, separate parts, such as L-brackets, may secure the divider 14 to the receptacle 17.

Figure 5A:
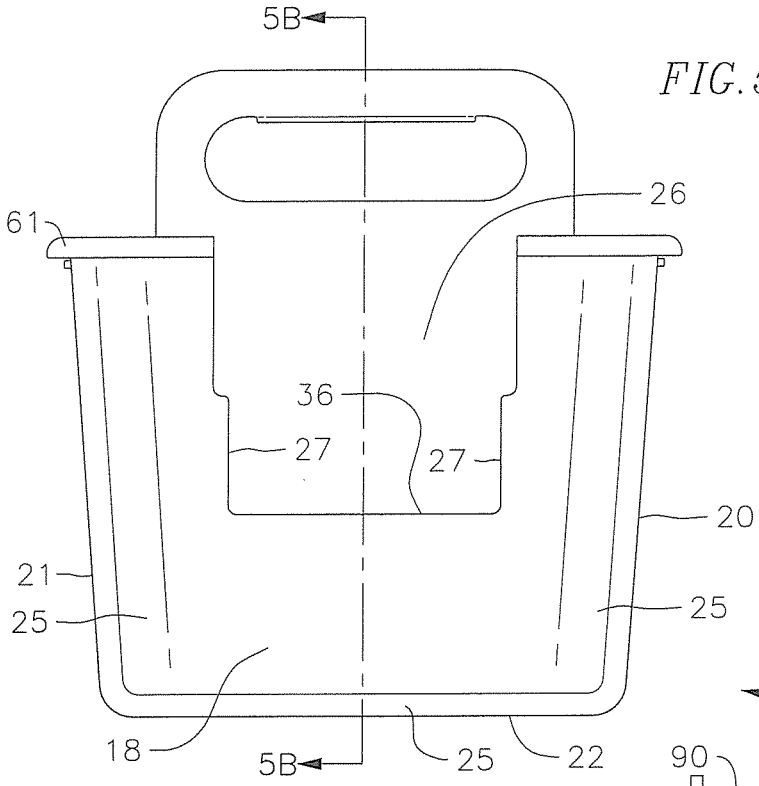
FIGS. 5A and 5B are a front view and a cross-sectional view of an embodiment of the wipes dispenser and disposal assembly.
Figure 5B:
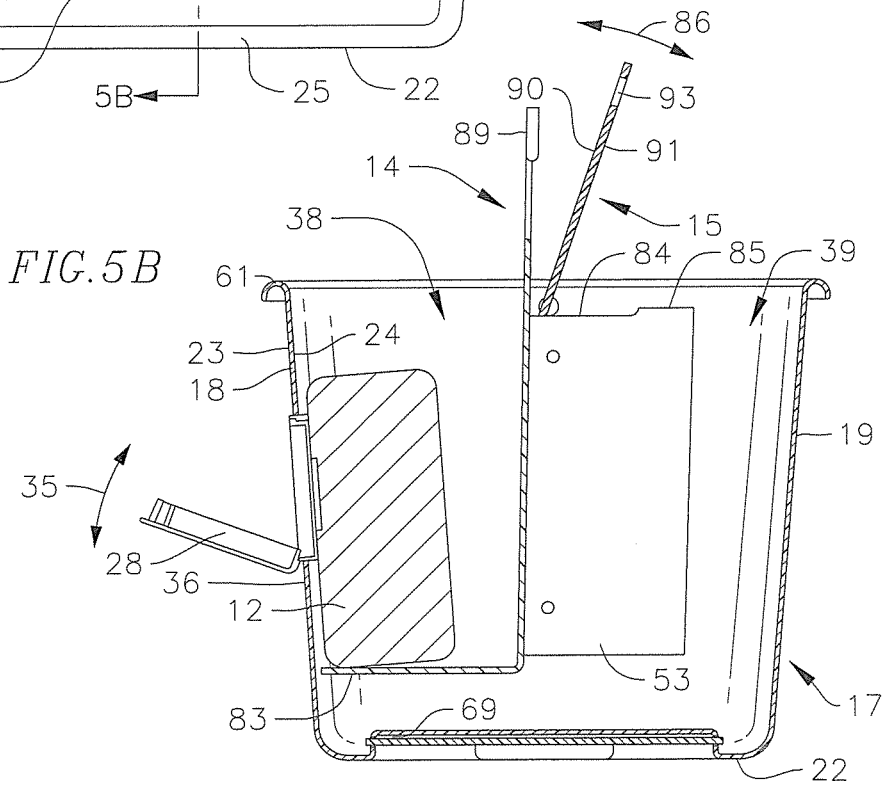

Still referring to FIG. 2, an upper portion of the attachment flaps 52, 53 contains a notch 84 forming a raised portion 85 configured to support the lid 15, as will be described in detail below. Additionally, the notch 84 formed on the upper portion of the attachment flaps 52, 53 permits the lid 15 to rotate (arrow 86) into an open configuration (FIGS. 3 and 5B). In one embodiment, the wall 80 of the divider 14 is configured to be located substantially equidistant from the front wall 18 and the rear wall 19 of the receptacle 17. In another embodiment, the wall 80 of the divider 14 may be located closer to the front wall 18 than the rear wall 19, as depicted in FIG. 5B, in order to conform the front cavity 38 to the shape of the package of disposable wipes 12 or to increase the storage capacity of the rear cavity 39.

In continued reference to FIG. 2, an upper portion of the wall 80 has a handle 87 configured to facilitate the portability of the wipes dispenser and disposal assembly 10. The handle 87 is formed from a relatively thin sheet extending upward from the wall 80 of the divider 14. The handle 87 has an ovaloid opening 88 configured accept a user's hand. In one embodiment, the lengthwise direction of the ovaloid opening 88 is substantially horizontal. In one embodiment, the handle 87 also has a raised portion 89 which reinforces the handle 87 and provides added comfort when the user transports the wipes dispenser and disposal assembly 10. The raised portion 89 may be formed by folding rearward the material stamped out to form the ovaloid opening 88 and then securing the folded material onto a rear surface of the handle 87.

With continued reference to FIG. 2, the return flange 83 of the divider 14 has rounded portions configured to conform to rounded portions 25 formed between the front wall 18 and the side walls 20, 21 of the receptacle 17. The return flange 83 is configured to act as a barrier preventing used wipes stored in the rear cavity 39 from migrating into the forward cavity 38 and thereby contaminating the package of disposable wipes 12 stored in the forward cavity 38. The return flange 83 also supports the package of disposable wipes 12 stored in the forward cavity 38. In one embodiment, the return flange 83 is spaced from the base 22 of the receptacle 17, thus forming an "L-shaped" rear cavity 39, as shown in FIG. 5B. In an alternative embodiment, the return flange 83 may rest flush against the base 22 of the receptacle 17. Moreover, while the divider 14 and the receptacle 17 have been described with reference to two separate parts, in an alternative embodiment the divider 14 and the receptacle 17 may be formed as a single integrated member.

With reference now to FIGS. 2-4, the lid 15 is formed from a relatively thin sheet having an upper surface 90 and a lower surface 91. The lid 15 is configured to cover the open upper portion of the rear cavity 39 and thereby secure the contents of the rear cavity 39, such as used disposable wipes. The lid 15 is rotatable (arrow 86) between a closed position (FIG. 4) and an open position (FIGS. 3 and 5B). A rear portion of the lid 15 contains an opening, such as a circular hole 93. A forward end of the lid 15 contains two protrusions 94, 95 extending outward from opposite sides of the lid 15. The two protrusions 94, 95 form a transverse axis about which the lid 15 is configured to rotate (arrow 86). The protrusions 94, 95 are configured to rotatably extend through openings 45 formed in the two side walls 20, 21 of the receptacle 17. The opening 93 in the lid 15 permits a user to rotate (arrow 86) the lid 15 into the open position (FIGS. 3 and 5B) by inserting a single finger through the opening 93 and supplying an upward force, as depicted in FIG. 3. The rear portion of the lid 15 also has rounded portions 96 configured to substantially conform to rounded portions 56 of the rear cavity 39 where the rear wall 19 joins the side walls 20, 21. In an alternative embodiment, the lid 15 may be comprised of a flexible material, such as rubber or silicone, having a plurality of convergent slits which permit the lid 15 to deform to form an opening through which the used wipes may be inserted into the rear cavity 39.

With reference now to FIGS. 3-5B, the front wall 18 of the receptacle 17 is formed from a relatively thin sheet having a front surface 23, a back surface 24, and rounded portions 25 where the front wall 18 joins the side walls 20, 21 and the base 22. In one embodiment, the front wall 18 has a notched or stepped rectangular opening 26 forming a guide channel 27. The guide channel 27 extends in a direction corresponding to the sloped angle of the front wall 18. The guide channel 27 is configured to receive and secure the lid assembly 13 connected to the package of dispensable wipes 12. The lid assembly 13 has an outer lid 28 hingedly connected to an inner lid 29. The inner lid 29 has an opening 34 through which disposable wipes may be removed from the package of disposable wipes 12. An example of the lid assembly 13 is shown and described in U.S. patent application Ser. No. 13/586,734, filed Aug. 15, 2012, which is hereby incorporated by reference in its entirety. In use, a user inserts the package of dispensable wipes 12 having the lid assembly 13 into the front cavity 38 of the receptacle 17 and slides the lid assembly 13 onto the guide channel 27.

Figure 5C:
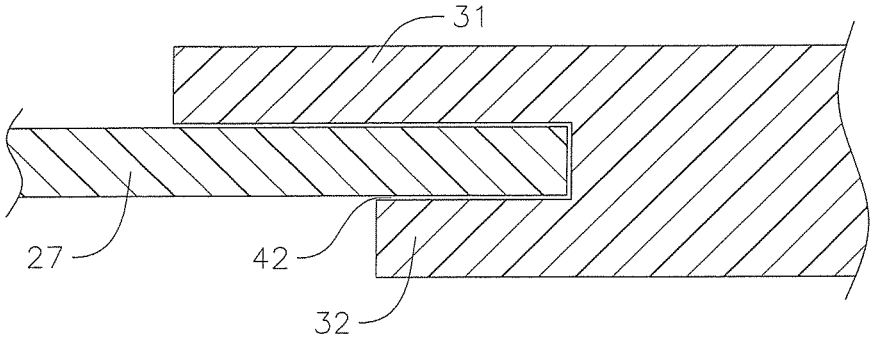
FIGS. 5C-5E are detailed cross-sectional views of embodiments of coupling arrangements between a container and an assembly of the present invention.

In one embodiment, as shown in detail in FIG. 5C, a flange 31 extends along a front surface of the inner lid 29 and a tab 32 extends from a rear surface of the inner lid 29, overlapping but spaced from the flange 31 such that the flange and the tab form a groove 42 configured to be coupled to the guide channel 27. The flange 31 formed on the inner lid 29 slides along the front surface 23 of the guide channel 27 and the tab 32 formed on the inner lid 29 slides along the back surface 24 of the guide channel 27. In this respect, the guide channel 27 and the lid assembly 13 act as tongue and groove joints. As will be appreciated, a similar structure is also formed by the flange 31 and another tab 33 located on the opposite side of the inner lid 29.

Again with reference also to FIGS. 3-5B, the guide channel 27 is configured to be located between the flange 31 and a respective one of the tabs 32 and 33 formed on the inner lid 29 in order to retain the package of disposable wipes 12 within the front cavity 38 when a user applies a forward force, such as by removing a wipe from the package of dispensable wipes 12 or opening (arrow 35) the lid assembly 13. Moreover, a lower portion of the front wall 18 comprises a lip 36 (FIG. 5B) which is configured to retain the package of wipes 12 inside the front cavity 38 of the receptacle 17. The guide channel 27 is also configured to engage the flange 31 formed on the lid assembly 13 to prevent the lid assembly 13 from falling into the front cavity 38 when the user applies a rearward force, such as by closing (arrow 35) the lid assembly 13 on the package of dispensable wipes 12. It will be appreciated that while the flange 31 and the tabs 32, 33 are shown and described as being on a front and rear surface, respectively, of the inner lid 29, the orientation of the flange and the tabs may be reversed. Further, the flange 31 and the tabs 32, 33 may extend from a central portion of the inner lid 29, and not necessarily from the front or rear surfaces thereof.

Figure 5D:
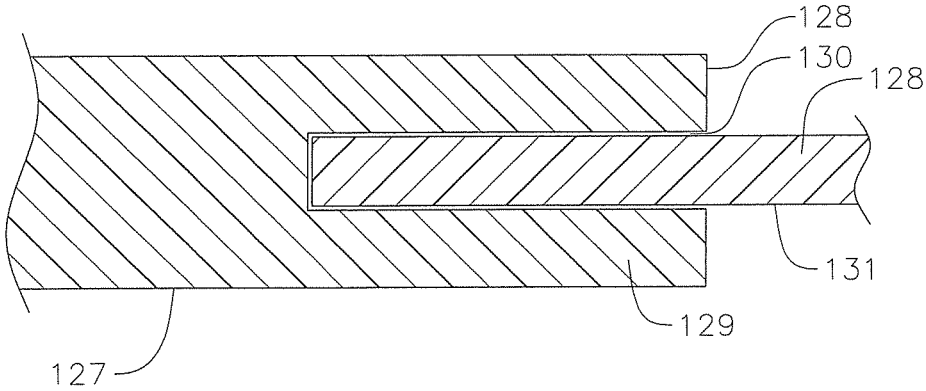

In another embodiment, as shown in FIG. 5D, a guide channel 127 has a forward ridge 128 extending from a forward edge of the guide channel and a rear ridge 129 extending from a rear edge of the guide channel to form a groove 130 in the guide channel rather than a groove being formed in the outer lid, as shown in FIG. 5C. As such, an outer lid 128 of the wipes package 12 need only have a single flange 131 that can be inserted between the forward ridge 128 and rear ridge 129 to hold the package within the guide channel. However, as will be appreciated, the outer lid 28 having the flange 31 and tabs 32, 33 could also be used with the guide channel 127 having two ridges 128, 129, for instance, by locating one of the ridges 128, 129 in the groove 42 and the other one of the ridges adjacent the flange 31 or the respective tab 32, 33.

Figure 5E:
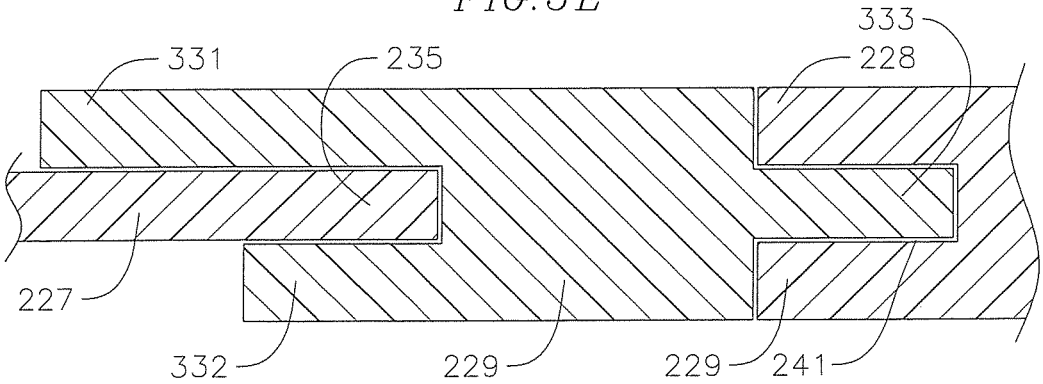

In yet another embodiment, as shown in FIG. 5E, a guide channel 227 can include one side having a single ridge 235 and a second side having a forward ridge 228 and a rear ridge 229 forming a groove 241 and similarly, an inner lid 229 can have one side having a flange 331 and a tab 332 spaced from the flange to form a groove 242 configured to receive the single ridge 235 and a second side having a flange 333 configured to fit within the groove 241.

Figure 6A:
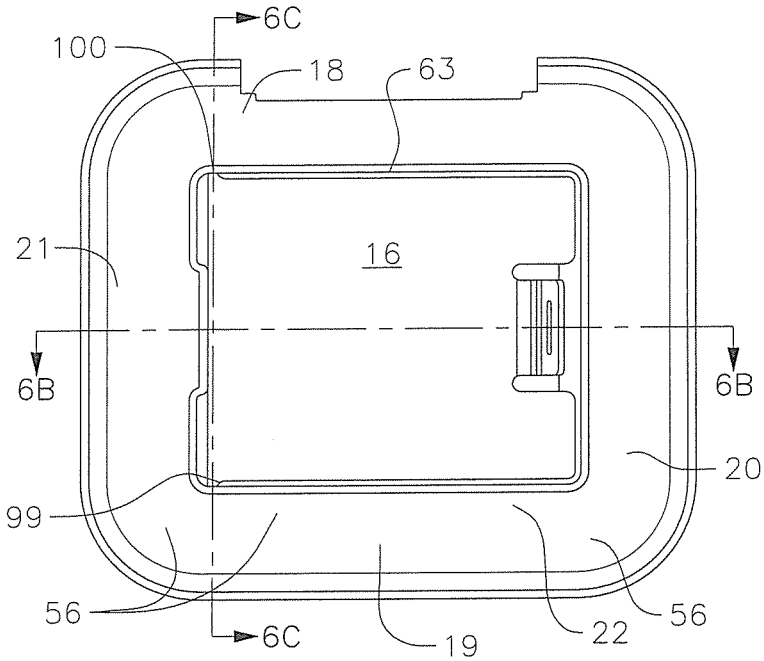
FIG. 6A is a bottom view of an embodiment of the wipes dispenser and disposal assembly.
Figure 6C:
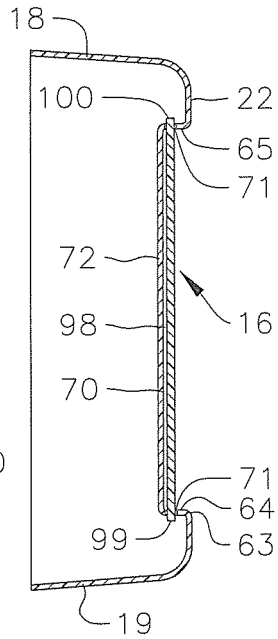
FIGS. 6B and 6C are enlarged cross-sectional views taken along lines B-B and C-C, respectively, of an embodiment of the wipes dispenser and disposal assembly.
Figure 6B:
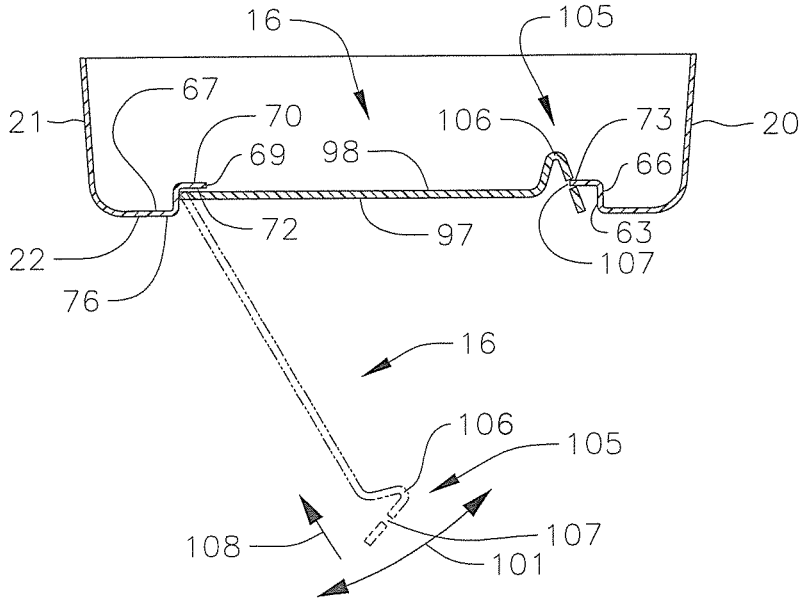
Figure 7:
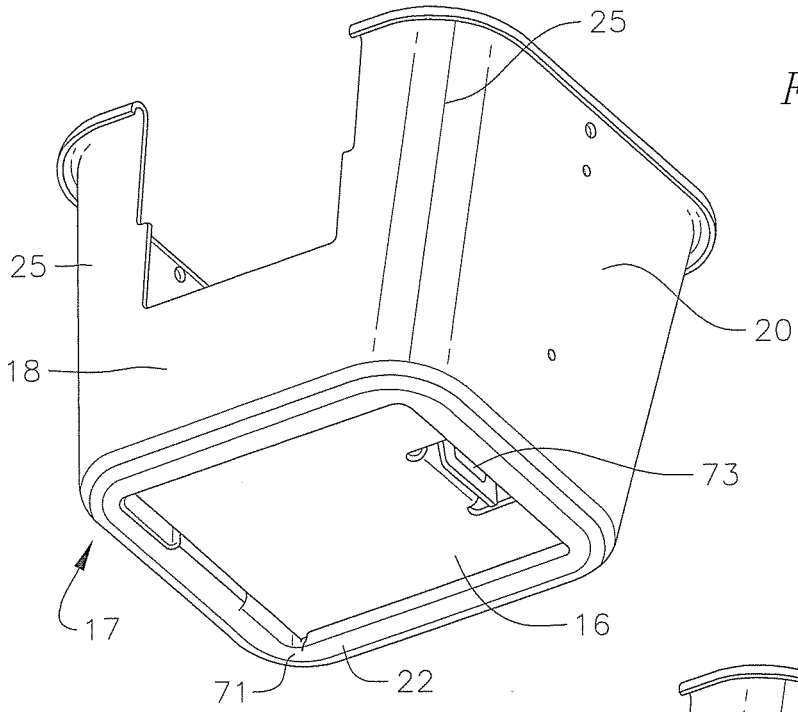
FIGS. 7 and 8 are perspective views of an embodiment of the door in a closed position and an open position, respectively.

Referring now to FIGS. 6A-8, the base 22 of the receptacle 17 is formed from a relatively thin sheet having an upper surface 75 and a lower surface 76. In one embodiment, illustrated in FIG. 8, the base 22 of the receptacle 17 has a substantially rectangular recess 62 configured to house the door 16. The recess 62 is formed from a larger rectangular opening 63 in the base 22 of the receptacle 17 and four walls 64, 65, 66, 67 (FIGS. 6B and 6C) extending upwardly from a peripheral region of the larger rectangular opening 63. In addition, the recess 62 of the receptacle 17 is formed by a flange 70 which is substantially co-planar with the base 22 of the receptacle 17 and which is joined to an upper end of the walls 64, 65, 66, 67. The flange 70 extends inwardly from the walls 64, 65, 66, 67. In one embodiment, two of the walls 64, 65 are substantially co-planar with the rear wall 19 and the front wall 18, and the other two walls 66, 67 are substantially co-planar with the side walls 20, 21. The flange 70 has rounded portions where the flange 70 joins the walls 64, 65, 66, 67. The flange 70 and the walls 64, 65, 66, 67 are formed from a relatively thin sheet. The flange 70 of the recess 62 has a rectangular opening 69 which opens into the rear cavity 39. The flange 70 is configured to extend over a peripheral portion of the door 16 which prevents the door 16 from entering the rear cavity 39 when the door 16 is moved between the open position (FIG. 8) and the closed position (FIG. 7). When in the closed position (FIG. 7), an upper surface 98 of the door 16 rests substantially flush against a lower surface 72 of the flange 70, as shown in FIGS. 6B and 6C. Additionally, the flange 70 contains an inwardly extending tab 73 configured to engage a clasp 105 formed on the door 16, as described below. Moreover, as depicted in FIG. 6C, the walls 64, 65 each contain an opening 71 configured to rotatably receive protrusions 99, 100 formed on the door 16.

Figure 8:
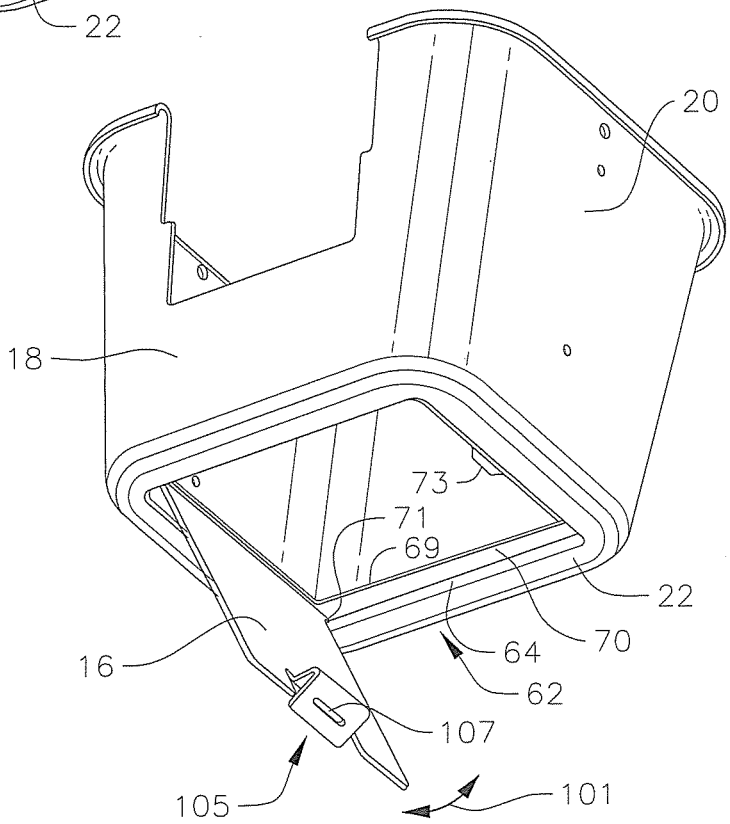

With continued reference to FIGS. 6A-8, the door 16 is formed on a bottom of the assembly 10 from a relatively thin rectangular sheet having a lower surface 97 and an upper surface 98. Because the door 16 is on the bottom of the assembly 10, it can be opened to allow the soiled wipes to be disposed into a waste receptacle without turning over the assembly 10, which may cause the wipes container to become dislodged from the assembly 10. Additionally, the door 16 permits a user to extract used wipes from the rear cavity 39 without having to reach into the rear cavity 39 and touch the used wipes, which may transfer bacteria and other undesirable material from the wipe to the user. That is, the door 16 is configured to permit the used wipes to fall out of the rear cavity 39 when the door 16 is moved into the open position (FIG. 8).

Still referring to FIGS. 6A-8, one end of the door 16 has two protrusions 99, 100 extending outwardly from opposite sides of the door 16. The two protrusions 99, 100 are configured to form a longitudinal axis about which the door 16 rotates (arrow 101) into the closed position (FIG. 7) and the open position (FIG. 8). Additionally, the two protrusions 99, 100 are configured to extend into the openings 71 formed in the recess 62 of the receptacle 17, as shown in FIG. 6C and described above. In one embodiment, an opposite end of the door 16 has a clasp mechanism 105 configured to secure the door 16 in the closed position (FIG. 7). The clasp mechanism 105 is formed from an "S-bend" 106 having a portion which is configured to extend above the upper surface 98 and a portion which is configured to extend below the lower surface 97 of the door 16 when the door 16 is closed. In addition, the clasp 105 has an ovaloid slot 107 which is configured to receive the tab 73 formed in the recess 62 of the receptacle 17.

To close the door 16, the user supplies a force (arrow 108) sufficient to elastically compress the S-bend 106 and rotates the door (arrow 101) into the closed position (FIG. 7). Compressing the S-bend 106 permits the door 16 to rotate into the closed position. Otherwise, the tab 73 formed on the recess 62 of the receptacle 17 would prevent the door 16 from rotating into the closed position (FIG. 7). The user then stops applying the force, and the restorative force supplied by the elastically compressed clasp 105 causes the S-bend 106 to expand such that the tab 73 engages the ovaloid slot 107 formed in the clasp 105, as shown in FIGS. 6B and 7. To open the door 16, the user performs the abovementioned steps in reverse. In an alternative embodiment, the door 16 may be secured in the closed position (FIG. 7) by other suitable means, such as a latch or hook-and-loop type fasteners. Moreover, the recess 62 formed in the base 22 of the receptacle 17 houses the door 16 and thereby permits the lower surface 76 of the base 22 of the receptacle 17 to rest flush against another surface, such as a table top. That is, the recess 62 is configured to fully nest the door 16 such that no portion of the door 16 extends below the lower surface 76 of the base 22, as illustrated in FIG. 6B. In an alternative embodiment, the door 16 may be configured to slide along rails in a plane defined by the base 22 of the receptacle 17.

The divider 14, the receptacle 17, the door 14, and the lid 15 may be formed from any suitably rigid and durable material, such as, acetal plastic, polyvinyl chloride (PVC), carbon fiber reinforced polymer, or aluminum alloy. The divider 14, the receptacle 17, the door 14, and the lid 15 may be formed from any suitable process, for example, stamping, liquid injection molding, welding, die cutting, or rapid prototyping using additive manufacturing.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims.

What is claimed is:

1. A dispenser and disposal assembly comprising:

a receptacle having a base, a front wall, a rear wall, and two side walls, the walls extending in a first direction from the base to form a cavity;

a divider in the cavity forming a first cavity and a second cavity;

a handle extending from the divider; and a door connected to the base of the receptacle, wherein the door is movable between a closed position and an open position.

2. The dispenser and disposal assembly of claim 1, wherein the front wall, the rear wall, and the two side walls extend from the base at an oblique angle.

3. The dispenser and disposal assembly of claim 1, wherein the handle has an opening.

4. The dispenser and disposal assembly of claim 1, further comprising a guide channel in the front wall, wherein the guide channel is configured to be coupled to a container.

5. The dispenser and disposal assembly of claim 4, wherein the guide channel is a cut-out having two opposing side edges.

6. The dispenser and disposal assembly of claim 4, wherein the guide channel has a first ridge and a second ridge spaced from and oriented generally parallel to the first ridge to form a groove therebetween.

7. The dispenser and disposal assembly of claim 4, wherein the guide channel comprises a first edge and a second edge of the front wall of the assembly, wherein the first edge is a flat surface and the second edge has a first ridge and a second ridge spaced from and oriented generally parallel to the first ridge to form a groove therebetween.

8. The dispenser and disposal assembly of claim 1, wherein the door is hingedly connected to the base.

9. The dispenser and disposal assembly of claim 1, wherein the door is rotatably connected to the base.

10. The dispenser and disposal assembly of claim 1, further comprising a clasp connected to the door for securing the door in the closed position.

11. The dispenser and disposal assembly of claim 1, further comprising a lid connected to the receptacle and covering the second cavity.

12. The dispenser and disposal assembly of claim 11, wherein the lid is hingedly connected to the receptacle.

13. The dispenser and disposal assembly of claim 1, further comprising a U-shaped lip extending along at least one of the rear wall, the front wall, and the side walls.

14. A dispenser and disposal assembly comprising:

a receptacle having a base, a front wall, a rear wall, and two side walls, the walls extending in a first direction from the base and to form a cavity, wherein the front wall has a guide channel being a cut-out having two opposing side edges;

a divider in the cavity forming a first cavity and a second cavity;

a handle extending from the divider;

a door connected to the base of the receptacle, wherein the door is movable between a closed position and an open position; and a container coupled to the guide channel.

15. The dispenser and disposal assembly of claim 14, wherein the container comprises a lid configured to be coupled to the guide channel.

16. The dispenser and disposal assembly of claim 14, wherein the container comprises a flange and a tab configuration forming a groove therebetween, and wherein the groove is slidable onto the guide channel.

17. The dispenser and disposal assembly of claim 14, wherein the guide channel has a first ridge and a second ridge spaced from and oriented generally parallel to the first ridge to form a groove therebetween.

18. The dispenser and disposal assembly of claim 14, wherein the guide channel comprises a first edge and a second edge of the front wall of the assembly, wherein the first edge is a flat surface and the second edge has a first ridge and a second ridge spaced from and oriented generally parallel to the first ridge to form a groove therebetween.

19. The dispenser and disposal assembly of claim 14, wherein the container is a wipes container.

* * * * *